US010982549B2

(12) United States Patent
Subramaniyan et al.

(10) Patent No.: US 10,982,549 B2
(45) Date of Patent: Apr. 20, 2021

(54) STATOR VANES INCLUDING CURVED TRAILING EDGES

(71) Applicant: General Electric Company, Schenectady, NY (US)

(72) Inventors: Moorthi Subramaniyan, Bangalore (IN); Adam John Fredmonski, Simpsonville, SC (US); Francesco Soranna, Fort Mill, SC (US)

(73) Assignee: General Electric Company, Schenectady, NY (US)

( * ) Notice: Subject to any disclaimer, the term of this patent is extended or adjusted under 35 U.S.C. 154(b) by 292 days.

(21) Appl. No.: 15/927,153

(22) Filed: Mar. 21, 2018

(65) Prior Publication Data

US 2018/0298760 A1 Oct. 18, 2018

(30) Foreign Application Priority Data

Apr. 17, 2017 (IN) ..... 201741013458

(51) Int. Cl.
*F01D 5/14* (2006.01)
*F01D 9/04* (2006.01)

(52) U.S. Cl.
CPC ..... *F01D 5/141* (2013.01); *F01D 9/041* (2013.01); *F05D 2240/121* (2013.01); *F05D 2240/122* (2013.01); *F05D 2250/711* (2013.01); *F05D 2250/712* (2013.01)

(58) Field of Classification Search
CPC ..... F01D 5/141; F01D 9/04; F01D 9/041
See application file for complete search history.

(56) References Cited

U.S. PATENT DOCUMENTS

| | | | | |
|---|---|---|---|---|
| 9,995,166 | B2 * | 6/2018 | Vandeputte | F01D 5/145 |
| 2012/0210715 | A1 * | 8/2012 | Shibata | F01D 5/141 60/670 |
| 2016/0290158 | A1 * | 10/2016 | Slavens | F01D 17/14 |
| 2018/0003066 | A1 * | 1/2018 | Green | F01D 9/041 |
| 2018/0149027 | A1 * | 5/2018 | Yang | F01D 9/041 |
| 2018/0298912 | A1 * | 10/2018 | Hall | F04D 29/164 |

* cited by examiner

*Primary Examiner* — Woody A Lee, Jr.
(74) *Attorney, Agent, or Firm* — Charlotte C. Wilson; James W. Pemrick

(57) ABSTRACT

Stator vanes including curved trailing edges are disclosed. The stator vanes may include a body including a central section, a tip section positioned radially above the central section, and a root section positioned radially below the central section. The body of the stator vanes may also include a leading edge extending radially adjacent the root section, central section, and tip section, respectively, and a trailing edge positioned opposite and aft to the leading edge. The trailing edge may include a concave contour including a first portion radially aligned with the central section of the body. The first portion may be axially offset and forward of a reference line that may be perpendicular to an axial direction and intersects the concave contour at the tip section and the root section. A concavity of the first portion of the concave contour may be formed radially aft of the central section.

17 Claims, 11 Drawing Sheets

STATOR VANES INCLUDING CURVED TRAILING EDGES

BACKGROUND OF THE INVENTION

The disclosure relates generally to turbine systems, and more particularly, to stator vanes for turbine systems include curved leading edges and/or curved trailing edges.

Conventional turbo machines, such as gas turbine systems, are utilized to generate power for electric generators. In general, gas turbine systems generate power by passing a fluid (e.g., hot gas) through a compressor and a turbine component of the gas turbine system. Once compressed, the inlet air is mixed with fuel to form a combustion product, which may be ignited by a combustor of the gas turbine system to form the operational fluid (e.g., hot gas) of the gas turbine system. The fluid may then flow through a fluid flow path for rotating a plurality of rotating blades and rotor or shaft of the turbine component for generating the power. The fluid may be directed through the turbine component via the plurality of rotating blades and a plurality of stator vanes positioned between the rotating blades. As the plurality of rotating blades rotate the rotor of the gas turbine system, a generator, coupled to the rotor, may generate power from the rotation of the rotor.

The various components of conventional turbo machines are designed to include unique, predetermined geometries to aid in the operational efficiency of the turbo machines while generating power. One component of conventional turbo machines that is continuously redesigned and/or modified is the stator vanes found in the turbine component. The stator vanes attribute greatly to the operational efficiencies of conventional turbo machines. Turning to FIG. 1, a perspective view of a conventional stator vane 10 is shown according to prior art. Stator vane 10 includes an airfoil 12. Conventional airfoil 12 of stator vane 10 includes a pressure side 18, and an opposed suction side 20. Airfoil 12 further includes a leading edge 22 between pressure side 18 and suction side 20, as well as, a trailing edge 24 between pressure side 18 and suction side 20 on a side opposing leading edge 22. As shown in FIG. 1, trailing edge 24 of conventional stator vanes 10 may include various geometries. In non-limiting examples, trailing edge 24 of conventional stator vanes 10 may include a substantially convex shape 26, a substantially linear shape 28 (shown in phantom) or a substantially concave shape 30 (shown in phantom).

While the geometries, shapes and/or features aid in improving operational efficiencies for conventional turbo machines during operation, conventional stator vanes including the geometries above still have operational inefficiencies and/or create undesirable operational issues for conventional turbo machines. For example, the wake effect in the combustion fluids as they flow from the stator vanes downstream to the rotating turbine blades may reduce the operational efficiencies of the turbo machines. Specifically, as the combustion fluid flows off and downstream from the airfoil 12 of conventional stator vane 10, the combustion fluid may spread from a desired flow path, and may prematurely and/or undesirable contact the rotating turbine blades before the turbine blades reach the desired position to contact and/or receive the combustion fluids. This in puts an undesirable stress on the rotating turbine blades.

Additionally, the formation of a boundary layer of combustion fluids on airfoil 12 of conventional stator vane 10 may result in undesirable operational issues for conventional turbo machines. For example, as the boundary layer of combustion fluids along airfoil 12 of the conventional stator vane 10 increases, the flow of combustion fluids may become turbulent and/or unsteady, which in turn results in the combustion fluids deviating from a desired flow path. Similar to the wake effect, when the combustion fluids become turbulent and/or unsteady within the turbine component, the operational efficiency of the turbo machines decreases.

BRIEF DESCRIPTION OF THE INVENTION

A first aspect of the disclosure provides a stator vane including a body including: a central section; a tip section positioned radially above the central section; a root section positioned radially below the central section, opposite the tip section; a leading edge extending radially adjacent the root section, the central section and the tip section; and a trailing edge positioned opposite and aft to the leading edge, the trailing edge including: a concave contour including a first portion radially aligned with the central section of the body, the first portion axially offset and forward of a reference line that is perpendicular to an axial direction and intersects the concave contour at the tip section and the root section, wherein a concavity of the first portion of the concave contour is formed radially aft of the central section.

A second aspect of the disclosure provides a turbine system including a rotor; a plurality of turbine blades positioned circumferentially around the rotor; and a plurality of stator vanes positioned adjacent and axially forward from the plurality of turbine blades, each of the plurality of stator vanes including: a body including: a central section; a tip section positioned radially above the central section; a root section positioned radially below the central section, opposite the tip section; a leading edge extending radially adjacent the root section, the central section and the tip section; and a trailing edge positioned opposite and aft to the leading edge, the trailing edge including: a concave contour including a first portion radially aligned with the central section of the body, the first portion axially offset and forward of a reference line that is perpendicular to an axial direction and intersects the concave contour at the tip section and the root section, wherein a concavity of the first portion of the concave contour is formed radially aft of the central section.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
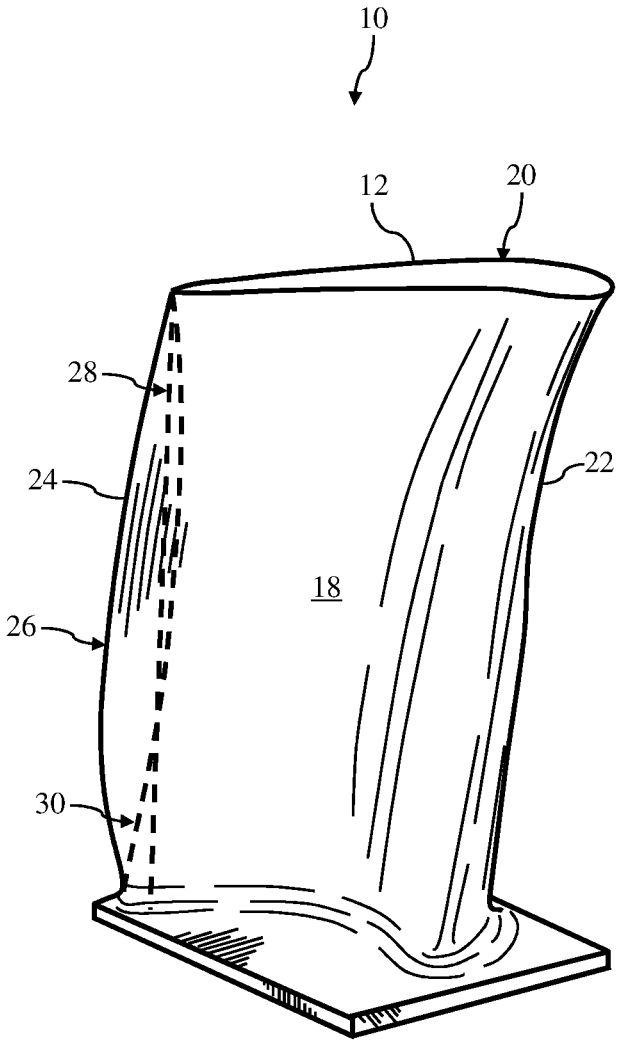
FIG. 1 (Prior Art)
FIG. 1 shows a perspective view of a stator vane of a turbine system according to prior art.

As an initial matter, in order to clearly describe the current disclosure it will become necessary to select certain terminology when referring to and describing relevant machine components within the scope of this disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. Additionally, the terms "leading" and "trailing" may be used and/or understood as being similar in description as the terms "forward" and "aft," respectively. It is often required to describe parts that are at differing radial, axial and/or circumferential positions. The "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along an axis "R" (see, FIG. 2), which is substantially perpendicular with axis A and intersects axis A at only one location. Finally, the term "circumferential" refers to movement or position around axis A (e.g., axis "C").

The following disclosure relates generally to turbine systems, and more particularly, to stator vanes for turbine systems include curved leading edges and/or curved trailing edges.

These and other embodiments are discussed below with reference to FIGS. 2-9. However, those skilled in the art will readily appreciate that the detailed description given herein with respect to these Figures is for explanatory purposes only and should not be construed as limiting.

Figure 2:
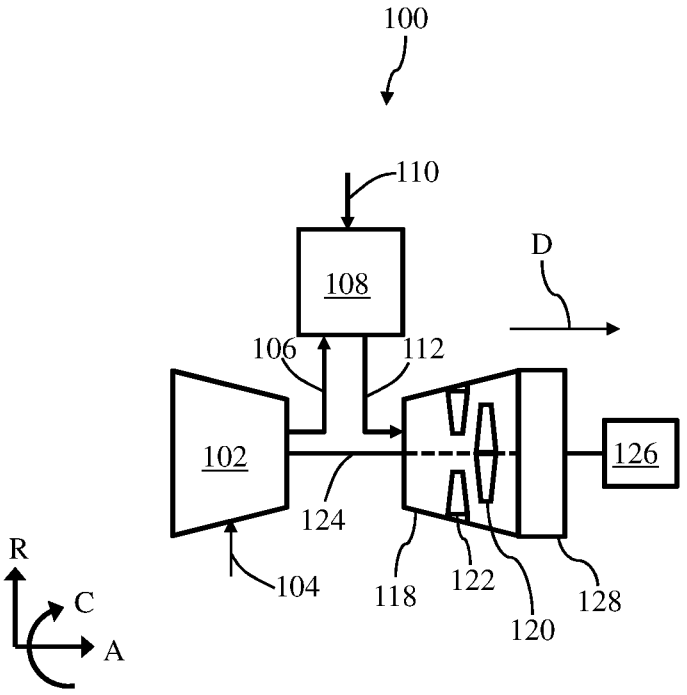
FIG. 2 shows a schematic diagram of a gas turbine system, according to embodiments.

FIG. 2 shows a schematic view of an illustrative gas turbine system 100. Gas turbine system 10 may include a compressor 102. Compressor 102 compresses an incoming flow of air 104. Compressor 102 delivers a flow of compressed air 106 to a combustor 108. Combustor 108 mixes the flow of compressed air 106 with a pressurized flow of fuel 110 and ignites the mixture to create a flow of combustion gases 112. Although only a single combustor 108 is shown, gas turbine system 100 may include any number of combustors 108. The flow of combustion gases 112 is in turn delivered to a turbine 118, which typically includes a plurality of stages turbine blades 120 and a plurality of stages of stator vanes 122. In the non-limiting example shown in FIG. 2, a single stage of turbine blades 120 and a single stage of stator vanes are shown. However it is understood that turbine 18 may include more stages of turbine blades 120 and/or stator vanes 122. As shown in FIG. 2, stator vanes 122 may be positioned adjacent to, axially aligned, axially forward and/or upstream of turbine blades 120 of turbine 118. The flow of combustion gases 112 drives turbine 118 to produce mechanical work. Specifically, when combustion gases 112 flows through turbine 118, combustion gases 112 flow over and are redirected by each stage of stator vanes 122 to a downstream stage of turbine blades 120. As a result, turbine blades 120, which are positioned on and/or circumferentially coupled to a rotor 124 of gas turbine system 100, may be circumferentially displaced to drive and/or rotate rotor 124. The mechanical work produced in turbine 118 drives compressor 102 via rotor 124 extending through turbine 118, and may be used to drive an external load 126, such as an electrical generator and/or the like.

Subsequent to combustion gases 112 flowing through and driving turbine 118, combustion gases 112 may be exhausted, flow-through and/or discharged through an exhaust frame 128, coupled to turbine 118, in a flow direction (D). In the non-limiting example shown in FIG. 2, combustion gases 112 may flow through exhaust frame 128 in the flow direction (D) and may be discharged from gas turbine system 100 (e.g., to the atmosphere). In another non-limiting example where gas turbine system 100 is part of a combined cycle power plant (e.g., including gas turbine system and a steam turbine system), combustion gases 112 may discharge from exhaust frame 128, and may flow in the flow direction (D) into a heat recovery steam generator of the combined cycle power plant.

Figure 3:
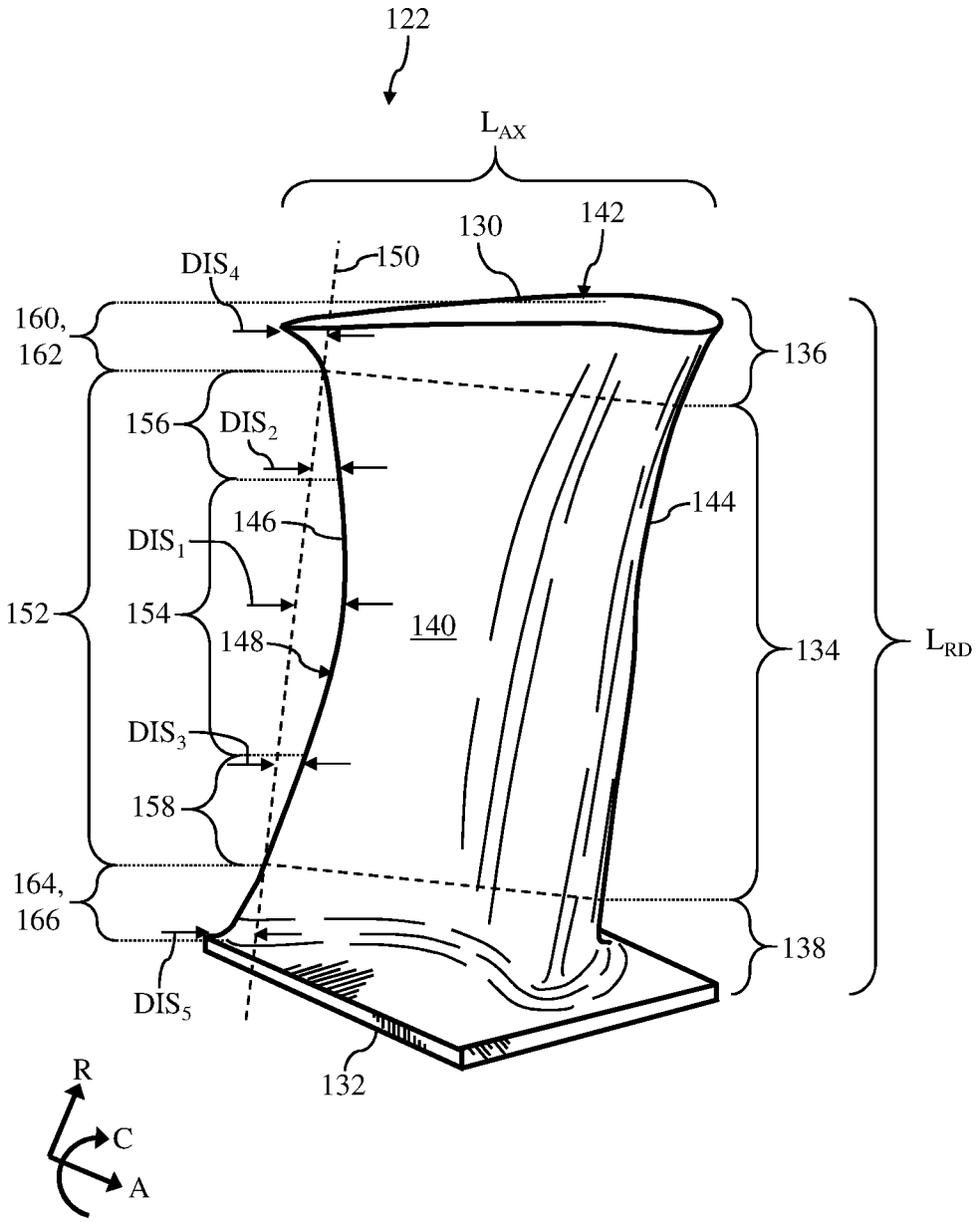
FIG. 3 shows a perspective view of a stator vane including a curved trailing edge of the gas turbine system of FIG. 2, according to embodiments.

Turning to FIG. 3, a perspective view of a stator vane 122 of gas turbine system 100 of FIG. 2 is shown. Stator vane 122 shown in FIG. 3 may be any stator vane included in the plurality of stator vanes of turbine 118 of gas turbine system 100. Stator vane 122 may include an airfoil or body 130 (hereafter, "body 130"). Body 130 of stator vane 122 may be positioned and/or extend radially between a platform, base and/or inner shroud 132 (hereafter, "inner shroud 132") and a cover, case and/or outer shroud (not shown for clarity) positioned radially above and/or opposite inner shroud 132. Body 130 of stator vane 122 may be formed integral to inner shroud 132 and/or outer shroud, or alternatively, may be formed separate from and subsequently fixed or coupled to inner shroud 132 and/or outer shroud of stator vane 122. As shown in the non-limiting example of FIG. 3, body 130 of stator vane 122 may, at least partially, be circumferentially swept, displaced and/or curved to aid moving and/or redirected combustion gases 112 as they flow through turbine 118 (see, FIG. 2), as discussed herein. Body 130, inner shroud 132 and outer shroud may be formed from any suitable material that may withstand the operational characteristics and/or attributes (e.g., combustion gases pressure, internal temperature, and so on) of gas turbine system 100. In non-limiting examples, body 130, inner shroud 132 and outer shroud may be formed from various and/or metals alloys. Additionally, body 130, inner shroud 132 and outer shroud may be formed using any suitable formation and/or manufacturing technique and/or process. In non-limiting examples, body 130, inner shroud 132 and outer shroud may be formed by additive manufacturing processes, casting, machining, and the like.

Body 130 may include various, radially defined segments and/or sections. For example, and as shown in FIG. 3, body 130 may include a central section 134. Central section 134 of body 130 may be centrally positioned, located and/or formed in the radial length ($L_{RD}$) of body 130 of stator vane 122. That is, central section 134 may be positioned, located and/or formed in body 130 substantially between and/or substantially equidistance from inner shroud 132 and outer shroud, respectively. In a non-limiting example, central section 134 of body 130 may be formed, span and/or disposed over approximately 50% to approximately 90% of the radial length ($L_{RD}$) of body 130. However, the size and/or radial length of central section 134 of body 130 discussed herein is merely illustrative. As such, it is understood that the size and/or radial length of central section 134 may be less than or greater than the approximately 50% to approximately 90% of the radial length ($L_{RD}$) of body 130.

Body 130 may also include a tip section 136 and a root section 138, respectively. As shown in the non-limiting example of FIG. 3, tip section 136 may be positioned, located and/or formed radially above central section 134. Tip section 136 may also be positioned, located and/or formed substantially adjacent and/or radially below outer shroud (not shown) of stator vane 122. In the non-limiting example, root section 138 may be positioned opposite tip section 136. Specifically, root section 138 may be positioned, located and/or formed radially below central section 134, and may be positioned, located and/or formed radially opposite and/or below tip section 136. As a result, central section 134 of body 130 may be positioned between and/or separate tip section 136 and root section 138. Root section 138 of body 130 may also be positioned, located and/or formed substantially adjacent and/or radially above inner shroud 132 of stator vane 122. In the non-limiting example shown in FIG. 3, the various sections (e.g., central section 134, tip section 136, root section 138) may be referenced sections of a single, unibody body 130 for stator vane 122. In another non-limiting example, the various sections of body 130 may be distinct components and/or parts that may be form and subsequently joined, fixed and/or coupled to form body 130 of stator vane 122.

Body 130 of stator vane 122 may also include a variety of edges and sides specific to the function and/or operations of turbine 118 of gas turbine system 100 (see, FIG. 2). For example, and as shown in FIG. 3, body 130 may include a pressure side 140 and a suction side 142, respectively. Pressure side 140 may be the side of body 130 that includes a substantially (and circumferentially) concave surface, curvature and/or geometry. Pressure side 140 of body 130 may receive and subsequently redirect combustion gases 112 downstream or aft, to a plurality of turbine blades 120 (see, FIG. 2). Suction side 142 of body 130 may be positioned circumferentially opposite pressure side 140. As shown in FIG. 3, suction side 142 may be the side of body 130 that includes a substantially (and circumferentially) convex surface, curvature and/or geometry, that may, at least partially, correspond to the concave surface of pressure side 140. The convex geometry of suction side 142 may aid in redirecting combustion gases 112 that may flow off of pressure side 140 of a circumferentially adjacent stator vane 122, and may direct combustion gases 112 downstream or aft, to a plurality of turbine blades 120 (see, FIG. 2). In the non-limiting example shown in FIG. 3, pressure side 140 and suction side 142, respectively, may both encompass and/or include all sections of body 130, including central section 134, tip section 136 and root section 138.

As shown in FIG. 3, body 130 of stator vane 122 may also include a leading edge 144. Leading edge 144 may be positioned forward and/or formed as the most upstream portion or position of body 130 of stator vane 122. That is, leading edge 144 may be positioned forward or upstream of, and may extend radially over the entire radial length ($L_{RD}$) of body 130. Additionally, leading edge 144 may extend radially over body 130, between inner shroud 132 and outer shroud (not shown), and adjacent central section 134, tip section 136 and root section 138, respectively. Leading edge 144 may be positioned between, and may substantially divide and/or define pressure side 140 and suction side 142 of body 130 of stator vane 122 at the upstream or forward edge. In the non-limiting example shown in FIG. 3, leading edge 144 of body 130 of stator vane 122 may include a substantially linear, non-curved geometry and/or shape. In other non-limiting examples discussed herein (see, FIG. 8) leading edge 144 may include a substantially curved (e.g., convex) contour, geometry and/or shape.

A trailing edge 146 of body 130 of stator vane 122 may be positioned opposite leading edge 144. Specifically, trailing edge 146 of body 130 may be positioned axially opposite and downstream or aft of leading edge 144. Trailing edge 146 may be positioned aft and/or formed as the most downstream portion or position of body 130 of stator vane 122. That is, trailing edge 146 may be positioned aft or downstream of, and may extend radially over the entire radial length ($L_{RD}$) of body 130. Additionally, trailing edge 146 may extend radially over body 130, between inner shroud 132 and outer shroud (not shown), and adjacent central section 134, tip section 136 and root section 138, respectively. Similar to leading edge 144, trailing edge 146 may be positioned between, and may substantially divide and/or define pressure side 140 and suction side 142 of body 130 of stator vane 122 at the downstream or aft edge. As shown in FIG. 3, and discussed herein, trailing edge 146 of body 130 may include a concave geometry, shape, curve and/or contour 148 (hereafter, "concave contour 148") that may substantially minimize the wake effect of gases (e.g., combustion gases 112, cooling fluid (not shown)) flowing downstream off of stator vane 122, while minimizing or maintaining a desired boundary layer of gases (e.g., combustion gases 112, cooling fluid (not shown)) formed on body 130 of stator vane 122.

Concave contour 148 of trailing edge 146 may be discussed herein with respect to the sections of body 130 (e.g., central section 134, tip section 136, root section 138) and a reference line 150 identified on and/or adjacent body 130 of stator vane 122. That is, reference line 150 positioned adjacent trailing edge 146 may be purely a reference line (e.g., not an actual, physical structure of stator vane 122) for providing and/or identifying measurements, shapes and/or geometries of concave contour 148 forming trailing edge 146. As shown in FIG. 3, reference line 150 may extend perpendicular to the axial direction (A) of stator vane 122, and/or radially over body 130 of stator vane 122. In the non-limiting example shown in FIG. 3, reference line 150 may also intersect concave contour 148 of trailing edge 146 at tip section 136 and root section 138, respectively. In other non-limiting examples discussed herein, reference line 150 may intersect concave contour 148 of trailing edge 146 where tip section 136 and root section 138 respectively end or terminate (see, FIG. 6).

The shape and/or position of reference line 150 with respect to body 130 of stator vane 122 may be dependent, at least in part, on what reference line 150 represents. In a non-limiting example, reference line 150 may represent an industry standard or threshold distance for body 130 of stator vane 122 to a downstream stage of turbine blades 120 in turbine 118. That is, reference line 150 of stator vane 122 may be a threshold line that indicates an industry standard or conventional distance between body 130 of stator vane 122 and a downstream or aft stage of turbine blades 120. The distance may radially extend between reference line 150 and a leading edge for the downstream turbine blades 120. In another non-limiting example, reference line 150 may represent a position and/or location of a trailing edge for a conventional stator vane (see, FIG. 1; stator vane 10). In this non-limiting example, reference line 150 may also represent and/or include a conventional shape and/or geometry for the trailing edge of the conventional stator vane. In the non-limiting example shown in FIG. 3, reference line 150 may represent the industry standard or threshold distance for body 130 of stator vane 122 to a downstream stage of turbine blades 120 in turbine 118 (see, FIG. 2).

Figure 4:
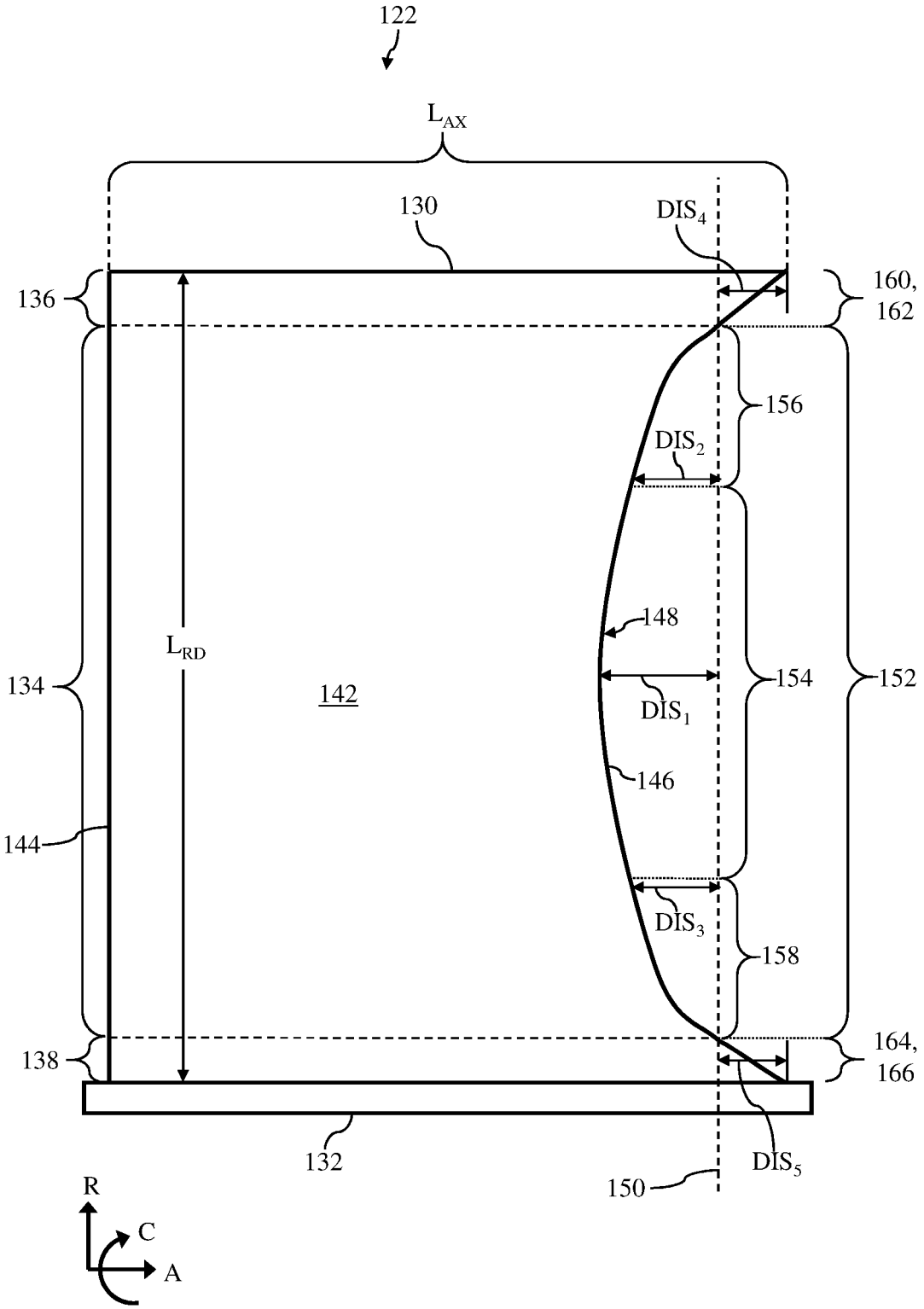
FIG. 4 shows a side view of the stator vane of FIG. 3, according to embodiments.

FIG. 4 shows a (suction) side view of stator vane 122. As shown in FIG. 4, and with continued reference to FIG. 3, concave contour 148 of trailing edge 146 for stator vane 122 may include a first portion 152. First portion 152 may be radially aligned with central portion 134 of body 130. That is, first portion of concave contour 148 may be radially aligned and/or extend radially adjacent central portion 134 of body 130 for stator vane 122. First portion 152 of concave contour 148 may be axially offset and forward/upstream of reference line 150. However, and as discussed herein, because first portion 152 of concave contour 148 includes a plurality of curvatures and/or a variable curvature, the distance between first portion 152 of concave contour 148 forming trailing edge 146 and reference line 150 may vary or change over the radial length of first portion 152. As shown in FIGS. 3 and 4, the concavity, geometry and/or shape of first portion 152 of concave contour 148 may be formed radially aft and/or downstream of central section 134 of body 130. That is, and as discussed herein, first portion 152 of concave contour 148 may move, curve, or sweep further forward in central section 134 as concave contour 148 moves closer to a center of central section 134, and may move, curve, or sweep further aft in central section 134 as concave contour 148 moves closer to tip section 136 and root section 138, respectively.

In a non-limiting example shown in FIGS. 3 and 4, first portion 152 of concave contour 148 may include a plurality of curvatures. Specifically, first portion 152 of concave contour 148 may include a first curvature 154, a second curvature 156 positioned and/or formed radially above first curvature 154, and a third curvature 158 positioned and/or formed radially below first curvature 154, opposite second curvature 156. Second curvature 156 may be positioned radially adjacent and below tip section 136 of body 130, and third curvature 158 may be positioned radially adjacent and above root section 138 of body 130. In a non-limiting example shown in FIGS. 3 and 4, first curvature 154 of concave contour 148 may be positioned and/or formed substantially forward and/or radially upstream of second curvature 156 and third curvature 158, respectively. Additionally, first curvature 154 of concave contour 148 may be positioned and/or formed substantially more forward and/or more upstream from reference line 150 than second curvature 156 and third curvature 158, respectively. In the non-limiting example shown in FIGS. 3 and 4, first curvature 154, second curvature 156 and third curvature 158 may all be completely and/or entirely forward and/or upstream of reference line 150. Also in the non-limiting example, both second curvature 156 and third curvature 158 both terminate or end where reference line 150 intersects concave contour 148 of trailing edge 146.

The various curvatures forming first portion 152 of concave contour 148 of trailing edge 146 may be distinct, or alternatively, some curvatures may include similar shapes, geometries and/or degrees of curvature. In the non-limiting example shown in FIGS. 3 and 4, first curvature 154 may be substantially distinct from second curvature 156 and third curvature 158, respectively. However in the non-limiting example, second curvature 156 may be substantially similar or identical to third curvature 158. In another non-limiting example, first curvature 154, second curvature 156, and third curvature 158 may all be distinct and/or unique from one another. In other non-limiting examples, first curvature 154 may be substantially similar or identical to second curvature 156 or third curvature 158.

Additionally, first portion 152 of concave contour 148 of trailing edge 146 may be positioned, formed, and/or axially offset, and forward and/or upstream of reference line 150 by an axial distance (DIS). That is, at least a portion of first curvature 154, second curvature 156, and third curvature 158 forming first portion 152 of concave contour, may be positioned and/or axially offset, and forward and/or upstream of reference line 150 by a predetermined axial distance ($DIS_1$, $DIS_2$, $DIS_3$). The predetermined axial distance may be predetermined and/or calculated based on, for example, an axial length ($L_{AX}$) of body 130. More specifically, the predetermined axial distance may be a predetermined and/or calculated ratio or percentage of the largest axial length ($L_{AX}$) of body 130. In the non-limiting example shown in FIGS. 3 and 4, the axial length ($L_{AX}$) of body 130 may be a distance between leading edge 144 and trailing edge 146, and the largest axial length ($L_{AX}$) of body 130 may be at the portion of tip section 136 formed directly adjacent an outer shroud (not shown) and/or the portion of root section 138 formed directly adjacent inner shroud 132 of stator vane 122. At its most forward point, first curvature 154 of first portion 152 may be positioned, formed and/or axially offset and forward of reference line 150 by a distance ($DIS_1$) of approximately 5% to approximately 25% of the axial length ($L_{AX}$) of body 130. In this non-limiting example, first curvature 154 of first portion 152 may also be axially offset and forward of an axially aligned, and aft or downstream turbine blade 120 (see, FIG. 2) by a predetermined axial distance that may be dependent, at least in part, on the axial length ($L_{AX}$) of body 130 and/or the axial position or stage of stator vane 122. Additionally, or alternatively, first curvature 154 of first portion 152 may be axially offset and forward of aft or downstream turbine blade 120 by a predetermined axial distance that may be based on a pitch of stator vanes 122. The pitch of stator vanes 122 may be an arc length or distance measured circumferentially between two adjacent stator vanes 122 of gas turbine system 100. As such, the predetermined axial distance may be a predetermined and/or calculated ratio or percentage of the pitch of stator vanes 122. In the non-limiting example shown in FIGS. 3 and 4, first curvature 154 of first portion 152 may be positioned, formed and/or axially offset and forward of turbine blade 120 by a distance ($DIS_1$) of approximately 10% to approximately 50% of the pitch of stator vanes 122 (arc length between adjacent vanes).

At its most forward point, second curvature 156 of first portion 152 may be positioned, formed and/or axially offset and forward of reference line 150 by a distance ($DIS_2$) of approximately 2% to approximately 20% of the axial length ($L_{AX}$) of body 130. Additionally, second curvature 156 of first portion 152 may be positioned, formed and/or axially offset and forward of turbine blade 120 by a distance ($DIS_2$) of approximately 5% to approximately 40% of the pitch of stator vanes 122 (arc length between adjacent vanes). Furthermore, at its most forward point, third curvature 158 of first portion 152 may be positioned, formed and/or axially offset and forward of reference line 150 by a distance ($DIS_3$) of approximately 2% to approximately 20% of the axial length ($L_{AX}$) of body 130. Third curvature 158 of first portion 152 may also be positioned, formed and/or axially offset and forward of turbine blade 120 by a distance ($DIS_3$) of approximately 5% to approximately 40% of the pitch of stator vanes 122.

As shown in FIGS. 3 and 4, concave contour 148 of trailing edge 146 may also include a second portion 160. Second portion 160 of concave contour 148 may be aligned (e.g., radially and/or axially) with tip section 136 of body 130 of stator vane 122. Additionally, second portion 160 of concave contour 148 may be formed and/or positioned radially above first portion 152 and the various curvatures (e.g., first curvature 154, second curvature 156, third curvature 158) forming first portion 152. In the non-limiting example shown in FIGS. 3 and 4, second portion 160 of concave contour 148 may be formed and/or positioned axially offset, and entirely aft or downstream of reference line 150 extending perpendicular to the axial direction and intersecting concave contour 148 at tip section 136. That is, and as discussed herein, second curvature 156 of first portion 152 of concave contour 148 may terminate on trailing edge 146 at reference line 150. As such, and as shown in the non-limiting example, reference line 150 intersecting concave contour 148 at tip section 136 may define a boundary or edge of second portion 160 of concave contour 148. Second portion 160 may extend, be disposed and/or radially span from first portion 152 of concave contour 148 to an end or termination of trailing edge 146 at tip section 136, and/or adjacent the outer shroud (not shown) positioned radially above tip section 136 of body 130.

Second portion 160 of concave curvature 148 of trailing edge 146 may include a fourth curvature 162. Fourth curvature 162 of second portion 160 may be positioned radially above first portion 152 of concave contour 148. More specifically, fourth curvature 162 of second portion 160 may be positioned radially above, and/or directly adjacent to second curvature 156 of first portion 152 of concave contour 148 for trailing edge 146. Fourth curvature 162 of second portion 160 may include a curvature that may be substantially distinct, or alternatively, substantially similar in shape, geometry and/or degree of curvature as a curvature forming first portion 152. In a non-limiting example shown in FIGS. 3 and 4, fourth curvature 162 of second portion 160 may be substantially distinct from second curvature 156 of first portion 152. In another non-limiting example, fourth curvature 162 of second portion 160 may be substantially similar to second curvature 156 of first portion 152.

Similar to first portion 152, second portion 160 of concave contour 148 of trailing edge 146 may be positioned, formed, and/or axially offset, and aft and/or downstream of reference line 150 by an axial distance (DIS). More specifically, fourth curvature 162 forming second portion 160 of concave contour 148, may be positioned and/or axially offset, and aft and/or downstream of reference line 150 by a predetermined axial distance ($DIS_4$). Similar to first portion 152, the predetermined axial distance ($DIS_4$) for fourth curvature 162 may be a predetermined and/or calculated ratio or percentage of the largest axial length ($L_{AX}$) of body 130 (e.g., tip section 136, root section 138). For example, at its most aft point, fourth curvature 162 of second portion 160 may be positioned, formed and/or axially offset and aft of reference line 150 by a distance ($DIS_4$) of approximately 5% to approximately 25% of the axial length ($L_{AX}$) of body 130. In this non-limiting example, fourth curvature 162 of second portion 160 may be axially offset and forward of an axially aligned, and aft or downstream turbine blade 120 (see, FIG. 2) by an axial distance ($DIS_4$) of approximately 10% to approximately 30% of the pitch of stator vanes 122 (arc length between adjacent vanes).

Concave contour 148 of trailing edge 146 may also include a third portion 164 that may be aligned (e.g., radially and/or axially) with root section 138 of body 130 of stator vane 122. Third portion 164 of concave contour 148 may be formed and/or positioned radially below first portion 152 and the various curvatures (e.g., first curvature 154, second curvature 156, third curvature 158) forming first portion 152, and/or radially opposite second portion 160. In the non-limiting example shown in FIGS. 3 and 4, and similar to second portion 160, third portion 164 of concave contour 148 may be formed and/or positioned axially offset, and entirely aft or downstream of reference line 150 extending perpendicular to the axial direction and intersecting concave contour 148 at root section 138. That is, and as discussed herein, third curvature 158 of first portion 152 of concave contour 148 may terminate on trailing edge 146 at reference line 150. As such, and as shown in the non-limiting example, reference line 150 intersecting concave contour 148 at root section 138 may define a boundary or edge of third portion 164 of concave contour 148. Third portion 164 may extend, be disposed and/or radially span from first portion 152 of concave contour 148 to an end or termination of trailing edge 146 at root section 138, and/or adjacent the inner shroud 132 positioned radially below root section 138 of body 130.

Third portion 164 of concave curvature 148 of trailing edge 146 may include a fifth curvature 166. Fifth curvature 166 of third portion 164 may be positioned radially below first portion 152 of concave contour 148. More specifically, fifth curvature 166 of third portion 164 may be positioned radially below, and/or directly adjacent to third curvature 158 of first portion 152 of concave contour 148 for trailing edge 146. Fifth curvature 166 of third portion 164 may include a curvature that may be substantially distinct, or alternatively, substantially similar in shape, geometry and/or degree of curvature as a curvature forming first portion 152. In a non-limiting example shown in FIGS. 3 and 4, fifth curvature 166 of third portion 164 may be substantially distinct from third curvature 158 of first portion 152. In another non-limiting example, fifth curvature 166 of third portion 164 may be substantially similar to third curvature 158 of first portion 152.

Additionally, third portion 164 of concave contour 148 of trailing edge 146 may be positioned, formed, and/or axially offset, and aft and/or downstream of reference line 150 by an axial distance (DIS). More specifically, fifth curvature 166 forming third portion 164 of concave contour 148, may be positioned and/or axially offset, and aft and/or downstream of reference line 150 by a predetermined axial distance ($DIS_5$). For example, at its most aft point, fifth curvature 166 of third portion 164 may be positioned, formed and/or axially offset and aft of reference line 150 by a distance ($DIS_5$) of approximately 5% to approximately 25% of the axial length ($L_{AX}$) of body 130. In this non-limiting example, fifth curvature 166 of third portion 164 may be axially offset and forward of an axially aligned, and aft or downstream turbine blade 120 (see, FIG. 2) by an axial distance ($DIS_5$) of approximately 10% to approximately 30% of the pitch of stator vanes 122 (arc length between adjacent vanes). Additionally, the axial distance ($DIS_5$) between fifth curvature 166 of third portion 164 and reference line 150 may be substantially similar or distinct from the axial distance ($DIS_4$) between fourth curvature 162 of second portion 160 and reference line 150.

Three distinct curvatures (e.g., first curvature 154, second curvature 156, third curvature 158) are discussed herein for forming first portion 152 of concave contour 148, and a single curvature (e.g., fourth curvature 162, fifth curvature 166) is discussed herein as forming second portion 160 and third portion 164, respectively. However, it is understood that more or less curvatures may form the various portions (e.g., first portion 152, second portion 160, third portion 164) of concave contour 148 for trailing edge 146. Additionally, the curvature relationships (e.g., similar curvatures, distinct curvatures) between the curvatures forming the various portions of concave contour 148 are merely illustrative. As such, any combination of curvature relationships may exist between the curvatures forming the various portions of concave contour 148. Furthermore, the distances of each curvature of the various portions of concave contour 148 from reference line 150 discussed herein are also illustrative. As such, and as discussed herein, each curvature forming the various portions of concave contour 148 may be separated from reference line 150 by any (axially) distance that may substantially minimize the wake effect of gases (e.g., combustion gases 112, cooling fluid (not shown)) flowing downstream off of stator vane 122, while minimizing or maintaining a desired boundary layer of gases formed on body 130 of stator vane 122.

Moreover, although discussed as curvatures, it is understood that any curvatures forming the various portions of concave contour 148 may be substantially linear and/or may include at least a portion that may be substantially linear. For example, it is understood that fourth curvature 162 of second portion 160 may not be substantially curved, but rather may be substantially linear. As a result, fourth curvature 162 of second portion 160 may linearly extend from end point of trailing edge 146 to second curvature 156 of first portion 152 of concave contour 148 for trailing edge 146.

Figure 5:
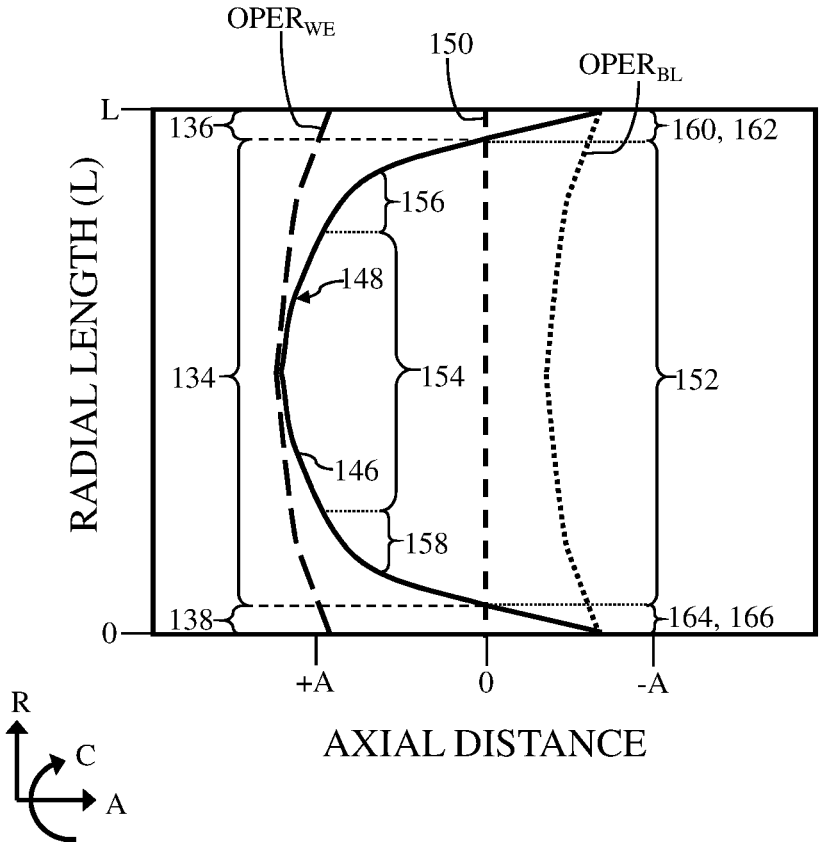
FIG. 5 shows a graph including a stator vane reference line, a concave contour geometry for the curved trailing edge of the stator vane of FIG. 3, and a plurality of operational reference lines, according to embodiments.

Turning to FIG. 5, the shape, geometry, curvature and/or contour of trailing edge 146 for stator vane 122 and its impact the wake effect and boundary layer of combustion gases 112 formed on body 130 of stator vane 122 may be discussed. FIG. 5 shows a graph including, reference line 150, concave contour 148 of trailing edge 146 of stator vane 122 (see, FIGS. 3 and 4), and a plurality of operational reference lines. In the non-limiting shown in FIG. 5, and as similarly discussed herein with respect to FIGS. 3 and 4, concave contour 148 of trailing edge 146, as shown in FIG. 5, may be substantially similar (e.g., structurally, geometrically, operationally, functionally, etc.) as trailing edge 146 of stator vane 122 discussed herein with respect to FIGS. 3 and 4. Additionally, reference line 150 may represent the industry standard or threshold distance for body 130 of stator vane 122 to a downstream stage of turbine blades 120 in turbine 118 (see, FIGS. 2-4). As such, redundant explanation of these components, and their functions/relationships are omitted for brevity.

FIG. 5 also shows a first operational reference line ($OPER_{WE}$) for minimizing the wake effect of combustion gases 112 flowing downstream off of stator vane 122 including concave contour 148 for trailing edge 146. Specifically, the first operational reference line ($OPER_{WE}$) may represent an axial displacement, positioning and/or formation of a trailing edge (e.g., trailing edge 146) for a stator vane (e.g., stator vane 122) to substantially minimize the wake effect of combustion gases 112 flowing downstream and/or off of the trailing edge of the stator vane. In the non-limiting example shown in FIG. 5, and similar to reference line 150, the first operational reference line ($OPER_{WE}$), and the axial displacement and/or position of the first operational reference line ($OPER_{WE}$), may represent a threshold distance for the trailing edge of the stator vane to a downstream stage of turbine blades 120 in turbine 118 (see, FIG. 2-4) to substantially minimize the wake effect of combustion gases. Additionally, and as shown in the non-limiting example, the first operational reference line ($OPER_{WE}$) may also include a unique shape, geometry and/or curvature for the trailing edge of the stator vane to minimize the wake effect for combustion gases 112. That is, in addition to showing an axial distance and/or position for the trailing edge to minimize the wake effect for combustion gases 112, the first operational reference line ($OPER_{WE}$) shown in FIG. 5 may also provide a shape, geometry and/or curvature for the trailing edge to substantially minimize the wake effect. As discussed herein, minimizing the wake effect for combustion gases 112 flowing from a trailing edge (e.g., trailing edge 146) of a stator vane (e.g., stator vane 122) may include, for example, eliminating the wake effect experienced by combustion gases 112. Additionally, or alternatively, minimizing the wake effect for combustion gases 112 flowing from a trailing edge of a stator vane may include, for example, reducing the wake effect for combustion gases 112, such that any experienced wake effect for combustion gases 112 may be negligible and/or may not reduce operational efficiencies of gas turbine system 100 (see, FIG. 2).

The first operational reference line ($OPER_{WE}$) for a trailing edge of the stator vane may be determined based on operational characteristics and/or ideal operations of gas turbine system 100, and its various components (e.g., combustion gases 112, turbine blades 120, stator vane 122 and so on). Specifically, the first operational reference line ($OPER_{WE}$), which represents the axial displacement and/or the shape or geometry for a trailing edge of a stator vane to minimize wake effect, may be determined, obtained and/or calculated based on real-time, measured operational characteristics of gas turbine system 100, and its various components. The real-time, measured operational characteristics of gas turbine system 100 may include, but are not limited to, a temperature of combustion gases 112, an internal temperature of turbine 118, rotational speed of rotor 124 and the like. Additionally, or alternatively, the first operational reference line ($OPER_{WE}$), which represents the axial displacement and/or the shape or geometry for a trailing edge of a stator vane to minimize wake effect, may be determined, obtained and/or calculated based on desired operational characteristics, and/or know physical properties of gas turbine system 100, and its various components. The desired operational characteristics, and/or know physical properties of gas turbine system 100 may include, but are not limited to, calculated, ideal temperature for combustion gases 112, calculated, ideal internal temperature for turbine 118, calculated, ideal rotational speed for rotor 124, number of stages of turbine blades 120, number of stages of stator vanes 122 and the like.

It may be determined and/or calculated that in order to minimize the wake effect for combustion gases 112, the axial offset and/or axial distance between a trailing edge of a stator vane and the downstream turbine blade (e.g., turbine blade 120; see, FIG. 2) may be increased from the industry standard (e.g., reference line 150). As such, and as shown in the non-limiting example shown in FIG. 5, the first operational reference line ($OPER_{WE}$) may be formed and/or positioned axially forward and/or upstream of reference line 150. It may also be determined and/or calculated that in order to minimize the wake effect for combustion gases 112 a trailing edge of a stator vane may include a curvature and/or a non-linear geometry. As shown in the non-limiting example in FIG. 5, the first operational reference line ($OPER_{WE}$) may be substantially curved, and/or may include portions positioned at the radial ends of the first operational reference line ($OPER_{WE}$) that may be positioned substantially aft or downstream from and/or closer to reference line 150 than a central area of the first operational reference line ($OPER_{WE}$). In the non-limiting example, the portions positioned at the radial ends of the first operational reference line ($OPER_{WE}$) that may be closer to reference line 150 than a central area may include, for example, a tip section (e.g., tip section 136) and a root section (e.g., root section 138), respectively, for a stator vane including the geometry of the first operational reference line ($OPER_{WE}$).

FIG. 5 also shows a second operational reference line ($OPER_{BL}$), distinct from the first operational reference line ($OPER_{WE}$). The second operational reference line ($OPER_{BL}$) may represent an axial displacement, positioning and/or formation of a trailing edge (e.g., trailing edge 146) for a stator vane (e.g., stator vane 122) to substantially minimize and/or maintain an optimum or desired boundary layer for combustion gases 112 flowing downstream and/or off of the trailing edge of the stator vane. In the non-limiting example shown in FIG. 5, and similar to reference line 150, the second operational reference line ($OPER_{BL}$), and the axial displacement and/or position of the second operational reference line ($OPER_{BL}$), may represent a threshold distance for the trailing edge of the stator vane to a downstream stage of turbine blades 120 in turbine 118 (see, FIG. 2-4) to substantially minimize or maintain a desired boundary layer of combustion gases 112. Additionally, and similar to the first operational reference line ($OPER_{WE}$), the second operational reference line ($OPER_{BL}$) may also include a unique shape, geometry and/or curvature for the trailing edge of the stator vane to minimize or maintain a desired boundary layer for combustion gases 112. That is, in addition to showing an axial distance and/or position for the trailing edge to minimize the wake effect for combustion gases 112, the second operational reference line ($OPER_{BL}$) shown in FIG. 5 may also provide a shape, geometry and/or curvature for the trailing edge to substantially minimize or maintain a desired boundary layer for combustion gases 112. As discussed herein, minimizing the boundary layer for combustion gases 112 flowing from a trailing edge (e.g., trailing edge 146) of a stator vane (e.g., stator vane 122) may include, for example, eliminating the boundary layer of combustion gases 112 on stator vane 112. Additionally, or alternatively, minimizing the boundary layer for combustion gases 112 flowing from a trailing edge of a stator vane may include, for example, reducing the boundary layer for combustion gases 112, such that any existing boundary layer for combustion gases 112 may be negligible and/or may not reduce operational efficiencies of gas turbine system 100 (see, FIG. 2). Maintaining the boundary layer for combustion gases 112 flowing from the stator vane may include, for example, ensuring that the boundary layer for combustion gases 112 does not grow and/or increase on the stator vane during operation of gas turbine system 100 (see, FIG. 2).

Similar to the first operational reference line ($OPER_{WE}$), the second operational reference line ($OPER_{BL}$) for a trailing edge of the stator vane may be determined based on operational characteristics and/or ideal operations of gas turbine system 100, and its various components (e.g., combustion gases 112, turbine blades 120, stator vane 122 and so on). Specifically, the second operational reference line ($OPER_{BL}$), which represents the axial displacement and/or the shape or geometry for a trailing edge of a stator vane to minimize the boundary layer of combustion gases 112, may be determined, obtained and/or calculated based on real-time, measured operational characteristics of gas turbine system 100, and its various components. Additionally, or alternatively, the second operational reference line ($OPER_{BL}$) may be determined, obtained and/or calculated based on desired operational characteristics, and/or know physical properties of gas turbine system 100, and its various components, as similarly discussed herein with respect to the first operational reference line ($OPER_{WE}$).

It may be determined and/or calculated that in order to minimize or maintain the boundary layer for combustion gases 112, the axial offset and/or axial distance between a trailing edge of a stator vane and the downstream turbine blade (e.g., turbine blade 120; see, FIG. 2) may be decreased from the industry standard (e.g., reference line 150). As such, and as shown in the non-limiting example shown in FIG. 5, the second operational reference line ($OPER_{BL}$) may be formed and/or positioned axially aft and/or downstream of reference line 150. This may be opposite to reducing the wake effect of combustion gases 112 on the stator vane, as represented by the first operational reference line ($OPER_{WE}$). It may also be determined and/or calculated that in order to minimize or maintain the boundary layer for combustion gases 112, a trailing edge of a stator vane may include a curvature and/or a non-linear geometry. As shown in the non-limiting example in FIG. 5, the second operational reference line ($OPER_{BL}$) may be substantially curved, and/or may include portions positioned at the radial ends of the second operational reference line ($OPER_{BL}$) that may be positioned substantially further aft or downstream from reference line 150 than a central area of the second operational reference line ($OPER_{BL}$). In the non-limiting example, and similar to the first operational reference line ($OPER_{WE}$), the portions positioned at the radial ends of the second operational reference line ($OPER_{BL}$) that may be more aft or downstream from reference line 150 than a central area may include, for example, a tip section and a root section, respectively, for a stator vane including the geometry of the second operational reference line ($OPER_{BL}$).

Additionally from the calculated and/or determined first operational reference line ($OPER_{WE}$) and second operational reference line ($OPER_{BL}$), it may be determined that certain portions of a trailing edge for a stator vane are more impacted by and/or experience more wake effect and/or boundary layer for combustion gases 112 than others. For example, it may be determined that the wake effect exponentially increases in the central of a trailing edge for stator vanes as the aft/downstream, axial distance increases from the industry standard (e.g., aft from reference line 150) when compared to the boundary layer of combustion gases 112 in the tip section and the root section, respectively. Additionally, and conversely, it may be determined that the boundary layer exponentially increases in the tip sections and root sections of a trailing edge for stator vanes as the forward/upstream, axial distance increases from the industry standard (e.g., forward from reference line 150) when compared to the boundary layer of combustion gases 112 in the central area.

As such, it may be determined that in order to substantially minimize the wake effect of combustion gases 112 flowing downstream off of the stator vane, while also minimizing or maintaining a desired boundary layer of combustion gases 112 formed on the stator vane, the central area of the stator vane should be positioned, formed and/or axially displaced substantially forward or upstream of reference line 150. Additionally, it may be determined that in order to substantially minimize the wake effect of combustion gases 112 flowing downstream off of the stator vane, while also minimizing or maintaining a desired boundary layer of combustion gases 112 formed on the stator vane 122, the tip section and root section, respectively, should be positioned substantially adjacent and/or aft or downstream of reference line 150. As shown in the non-limiting example of FIG. 5, concave curvature 148 for trailing edge 146 may be formed to achieve this relationship. Specifically as shown in FIG. 5, and as discussed in detail herein with respect to FIGS. 3 and 4, first portion 152 of concave contour 148 for trailing edge 146 may be positioned substantially forward and/or axial upstream of reference line 150 and/or first curvature 154 may be positioned substantially adjacent the first operational reference line ($OPER_{WE}$). Additionally in the non-limiting example, both second portion 160 and third portion 164 of concave contour 148 for trailing edge 146 may be positioned substantially aft and/or axial downstream of reference line 150 and/or may be positioned substantially adjacent the second operational reference line ($OPER_{BL}$). As such, the shape, curvature and/or geometry of concave contour 148 for trailing edge 146 of stator vane 122 (see, FIGS. 3 and 4), as discussed herein, may substantially minimize the wake effect of combustion gases 112 flowing downstream off of stator vane 122, while also minimizing or maintaining a desired boundary layer of combustion gases 112 formed on stator vane 122.

FIGS. 6-11 show additional, non-limiting examples of stator vane 122 that may be formed and/or include curvatures to substantially minimize the wake effect of combustion gases 112 flowing downstream off of stator vane 122, while also minimizing or maintaining a desired boundary layer of combustion gases 112 formed on stator vane 122. It is understood that similarly numbered and/or named components may function in a substantially similar fashion. Redundant explanation of these components has been omitted for clarity.

Figure 6:
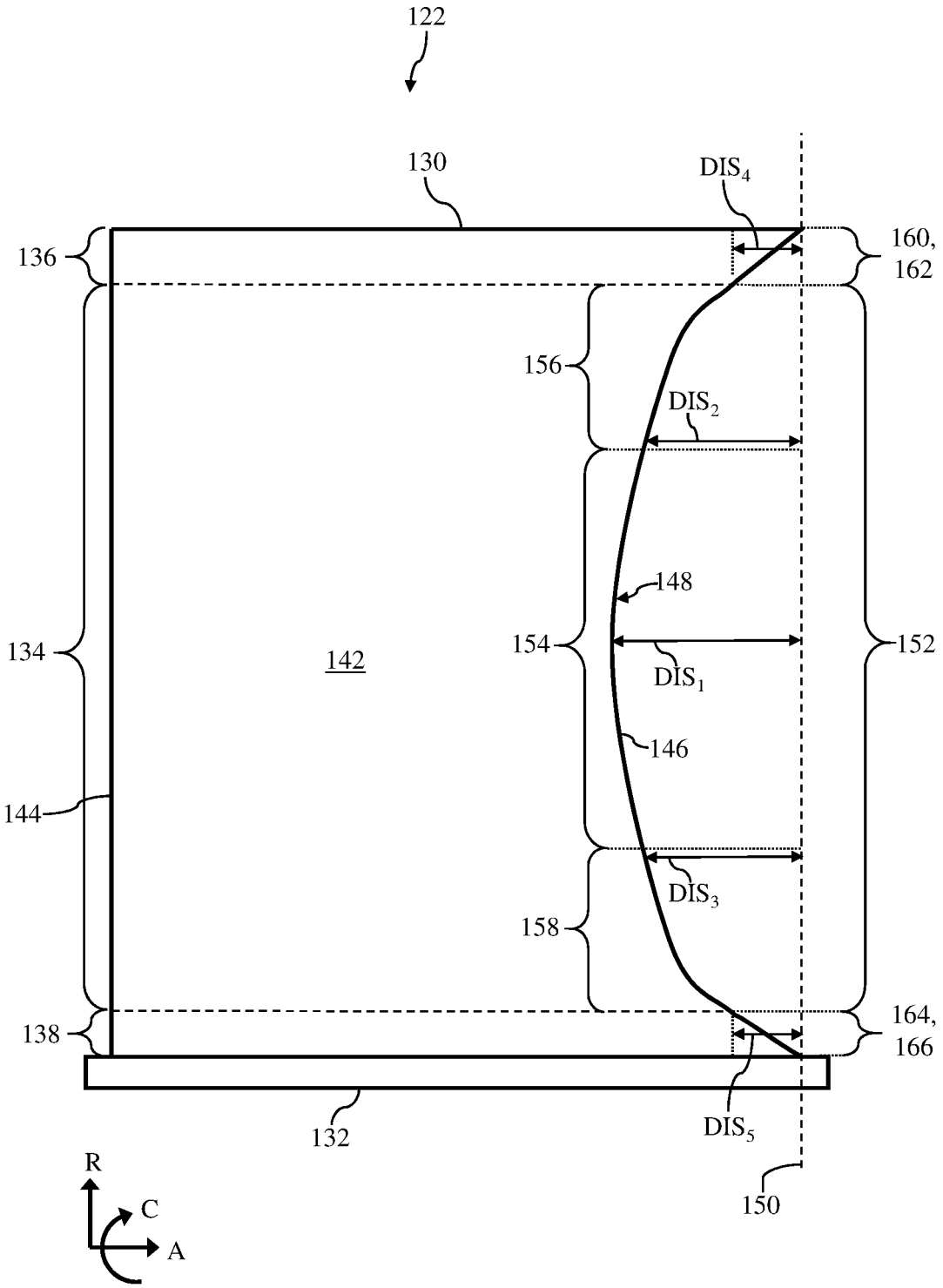
FIG. 6 shows a side view of a stator vane including a curved trailing edge of the gas turbine system of FIG. 2, according to additional embodiments.
Figure 7:
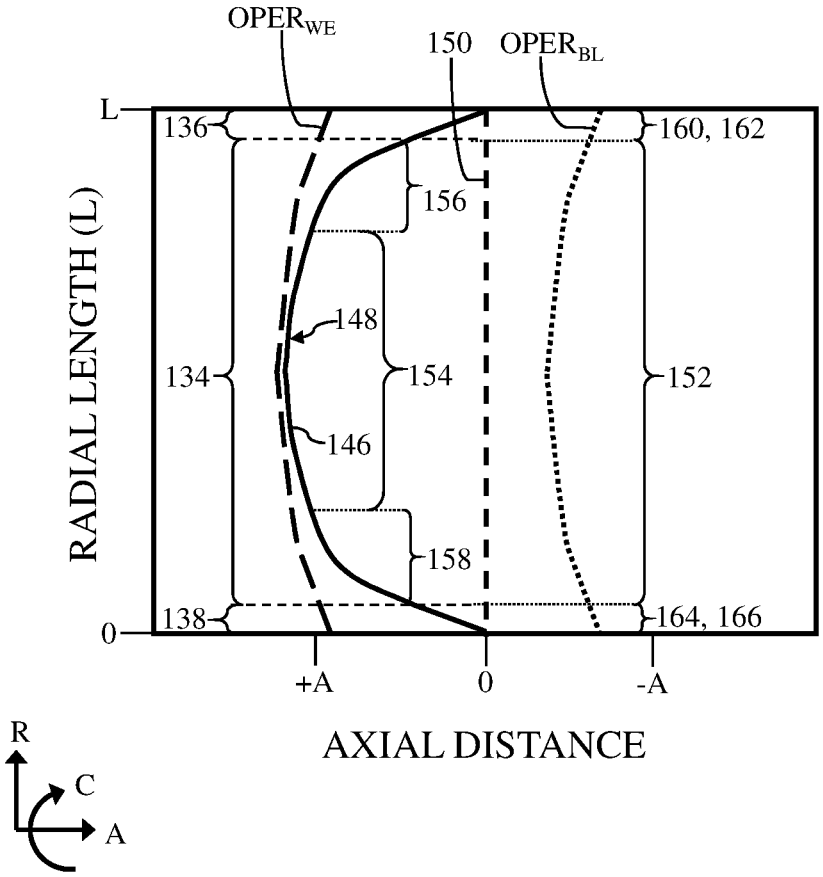
FIG. 7 shows a graph including a stator vane reference line, a concave contour geometry for the curved trailing edge of the stator vane of FIG. 6, and a plurality of operational reference lines, according to additional embodiments.

As shown in FIGS. 6 and 7, a non-limiting example of stator vane 122 may include substantially all of trailing edge 146 of body 130 axially offset and forward and/or upstream of reference line 150. Specifically in the non-limiting example, concave contour 148 for trailing edge 146 may be positioned, formed, displaced and/or axially offset, and forward/upstream of reference line 150 extending radially and/or perpendicular to the axial direction of stator vane 122. As shown in FIGS. 6 and 7, reference line 150 may intersect concave contour 148 of trailing edge 146 at the respect ends and/or termination points of concave contour 148. Additionally, reference line 150 may intersect body 130 at the respect ends and/or termination points for tip section 136 and root section 138, respectively. As a result, and as shown in FIG. 6, second portion 160 and third portion 164, respectively, of concave contour 148 may both be positioned axially offset, and forward and/or upstream of reference line 150. Similar to the non-limiting examples discussed herein, and also shown in FIG. 6, first portion 152 of concave contour 148 may be positioned and/or axially offset, and forward and/or upstream of reference line 150.

With respect to the first operational reference line ($OPER_{WE}$) and the second operational reference line ($OPER_{BL}$) shown in FIG. 7, first portion 152 of concave contour 148 for trailing edge 146 may be positioned, formed and/or axially offset in a substantially similar manner as concave contour 148 shown and discussed herein with respect to FIGS. 3-5. That is, first portion 152 of concave contour 148 for trailing edge 146 may be positioned substantially forward and/or axial upstream of reference line 150 and/or first curvature 154 may be positioned substantially adjacent the first operational reference line ($OPER_{WE}$). In the non-limiting example shown in FIG. 7, both second portion 160 and third portion 164 of concave contour 148 for trailing edge 146 may be positioned substantially forward and/or axial upstream of reference line 150, as well as, the second operational reference line ($OPER_{BL}$). However, in the non-limiting example, both second portion 160 and third portion 164 of concave contour 148 for trailing edge 146 may be positioned, formed and/or axially offset substantially closer to the second operational reference line ($OPER_{BL}$) than first portion 152 of concave contour 148. As a result, the shape, curvature and/or geometry of concave contour 148 for trailing edge 146 of stator vane 122 shown in FIGS. 6 and 7, may substantially minimize the wake effect of combustion gases 112 flowing downstream off of stator vane 122, while also minimizing or maintaining a desired boundary layer of combustion gases 112 formed on stator vane 122.

Figure 8:
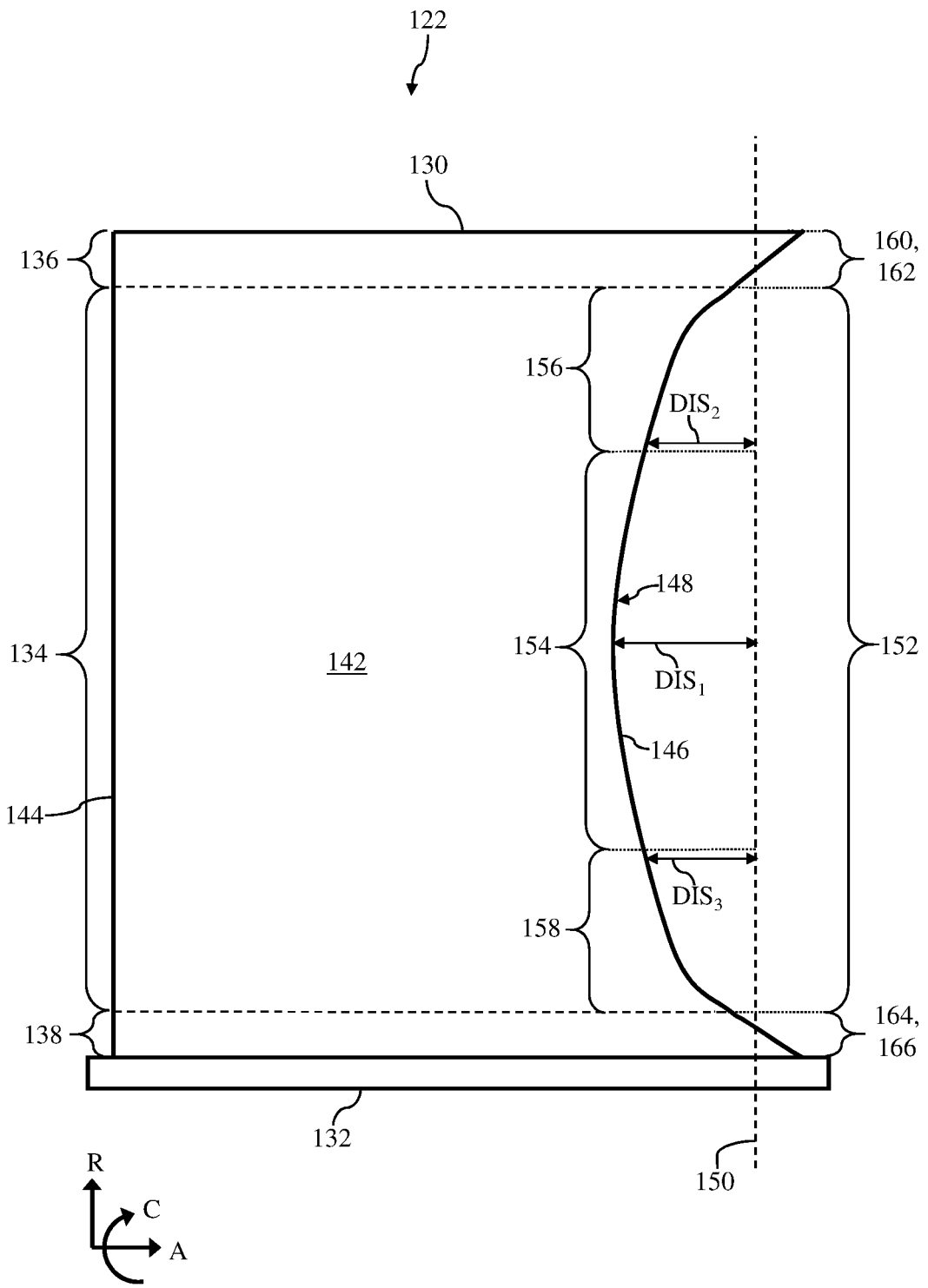
FIG. 8 shows a side view of a stator vane including a curved trailing edge of the gas turbine system of FIG. 2, according to further embodiments.
Figure 9:
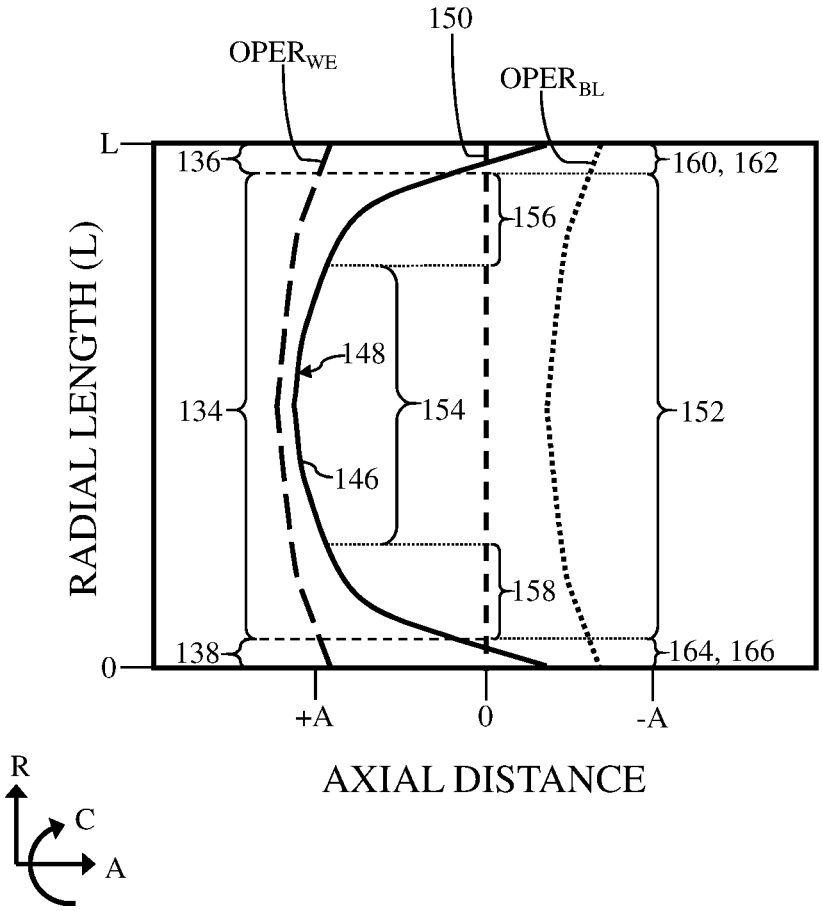
FIG. 9 shows a graph including a stator vane reference line, a concave contour geometry for the curved trailing edge of the stator vane of FIG. 8, and a plurality of operational reference lines, according to further embodiments.

In another non-limiting example shown in FIGS. 8 and 9, and with comparison to FIGS. 3-5, additional portions of concave contour 148 for trailing edge 146 of body 130 may be axially offset and forward and/or upstream of reference line 150. Specifically in the non-limiting example, in addition to first portion 152 of concave contour 148 being positioned, formed, displaced and/or axially offset, and forward/upstream of reference line 150, at least a portion of second portion 160 and third portion 164, respectively of concave contour 148 may also be axially offset, and forward/upstream of reference line 150. That is, both second portion 160 and third portion 164 of concave contour 148 may be partially aft and partially forward of reference line 150. As such, and shown in FIGS. 8 and 9, reference line 150 may intersect concave contour 148 of trailing edge 146 (partially) through fourth curvature 162 of second portion 160 and fifth curvature 164 of third portion 164, respectively, of concave contour 148. Additionally, reference line 150 may intersect body 130 at tip section 136 and root section 138, respectively, as discussed herein. As a result, and as shown in FIGS. 8 and 9, second portion 160 and third portion 164, respectively, of concave contour 148 may be substantially divided by reference line 150.

With respect to the first operational reference line ($OPER_{WE}$) and the second operational reference line ($OPER_{BL}$) shown in FIG. 9, first portion 152 of concave contour 148 for trailing edge 146 may be axially offset in a substantially similar manner as concave contour 148 shown and discussed herein with respect to FIGS. 3-5. That is, first portion 152 of concave contour 148 for trailing edge 146 may be positioned substantially forward and/or axial upstream of reference line 150 and/or first curvature 154 may be positioned substantially adjacent the first operational reference line ($OPER_{WE}$). However in the non-limiting example shown in FIG. 9, both second portion 160 and third portion 164 of concave contour 148 for trailing edge 146 may be positioned on both sides of reference line 150. That is, a portion of second portion 160 and third portion 164, respectively, may be axially offset, and forward or upstream of reference line 150, while distinct portions of second portion 160 and third portion 164 may be positioned substantially aft and/or axial downstream of reference line 150. In the non-limiting example, the entirety of second portion 160 and third portion 164 of concave contour 148 may be axially offset, and forward or upstream of the second operational reference line ($OPER_{BL}$). As similarly discussed herein, both second portion 160 and third portion 164 of concave contour 148 for trailing edge 146 may be positioned, formed and/or axially offset substantially closer to the second operational reference line ($OPER_{BL}$) than first portion 152 of concave contour 148. As a result, the shape, curvature and/or geometry of concave contour 148 for trailing edge 146 of stator vane 122 shown in FIGS. 8 and 9, may substantially minimize the wake effect of combustion gases 112 flowing downstream off of stator vane 122, while also minimizing or maintaining a desired boundary layer of combustion gases 112 formed on stator vane 122.

Figure 10:
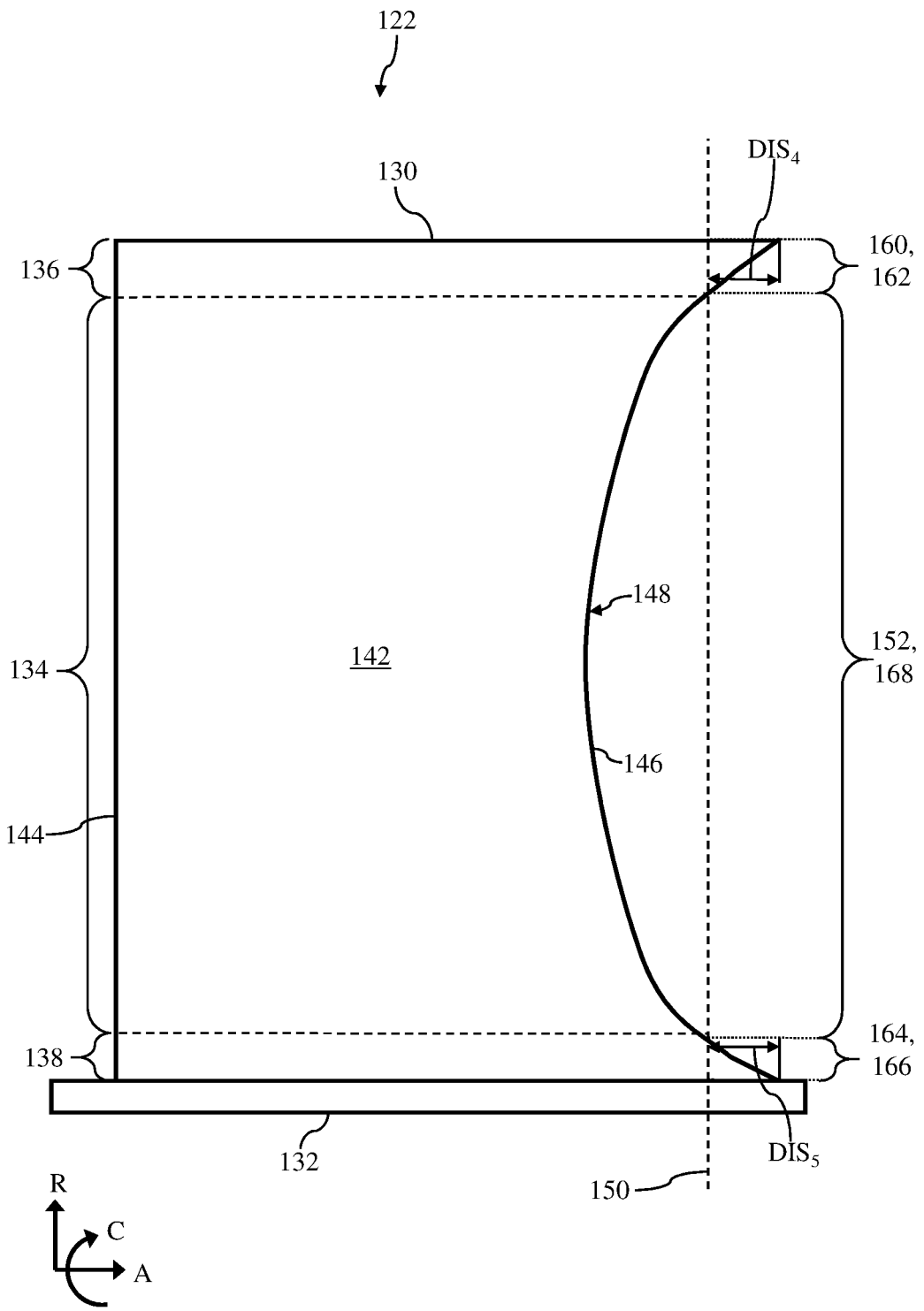
FIG. 10 shows a side view of a stator vane including a curved trailing edge of the gas turbine system of FIG. 2, according to another embodiment.

As shown in FIG. 10, another non-limiting example of stator vane 122 may include trailing edge 146 of body 130 formed substantially similar with respect to reference line 150 as discussed herein with respect to FIGS. 3-5. Specifically, first portion 152 of concave contour 148 of trailing edge 146 may be axially offset and forward or upstream of reference line 150, and second portion 160 and third portion 164 of concave contour 148 may both be axially offset and aft or downstream of reference line 150. Additionally, and as similarly discussed herein, reference line 150 may intersect concave contour 148 of trailing edge 146 at tip section 136 and root section 138, respectively, and/or where first portion 152, and second portion 160 or third portion 164 end, terminate and/or transition.

However, distinct form stator vanes discussed herein with respect to FIGS. 3-9, first portion 152 of concave contour 148 for trailing edge 146 may not include and/or be formed from a plurality of distinct curvatures (e.g., first curvature 154, second curvature 156 and so on). Rather, concave contour 148 for trailing edge 146 shown in FIG. 10 may include a variable curvature 168. Specifically in the non-limiting example shown in FIG. 10, concave contour 148 for trailing edge 146 may include and/or be formed from variable curvature 168. Variable curvature 168 may be (radially and/or axially) aligned with central portion 134 of body 130. Additionally, variable curvature 168 may extend and/or span radially between second portion 160 and third portion 164, respectively.

Figure 11:
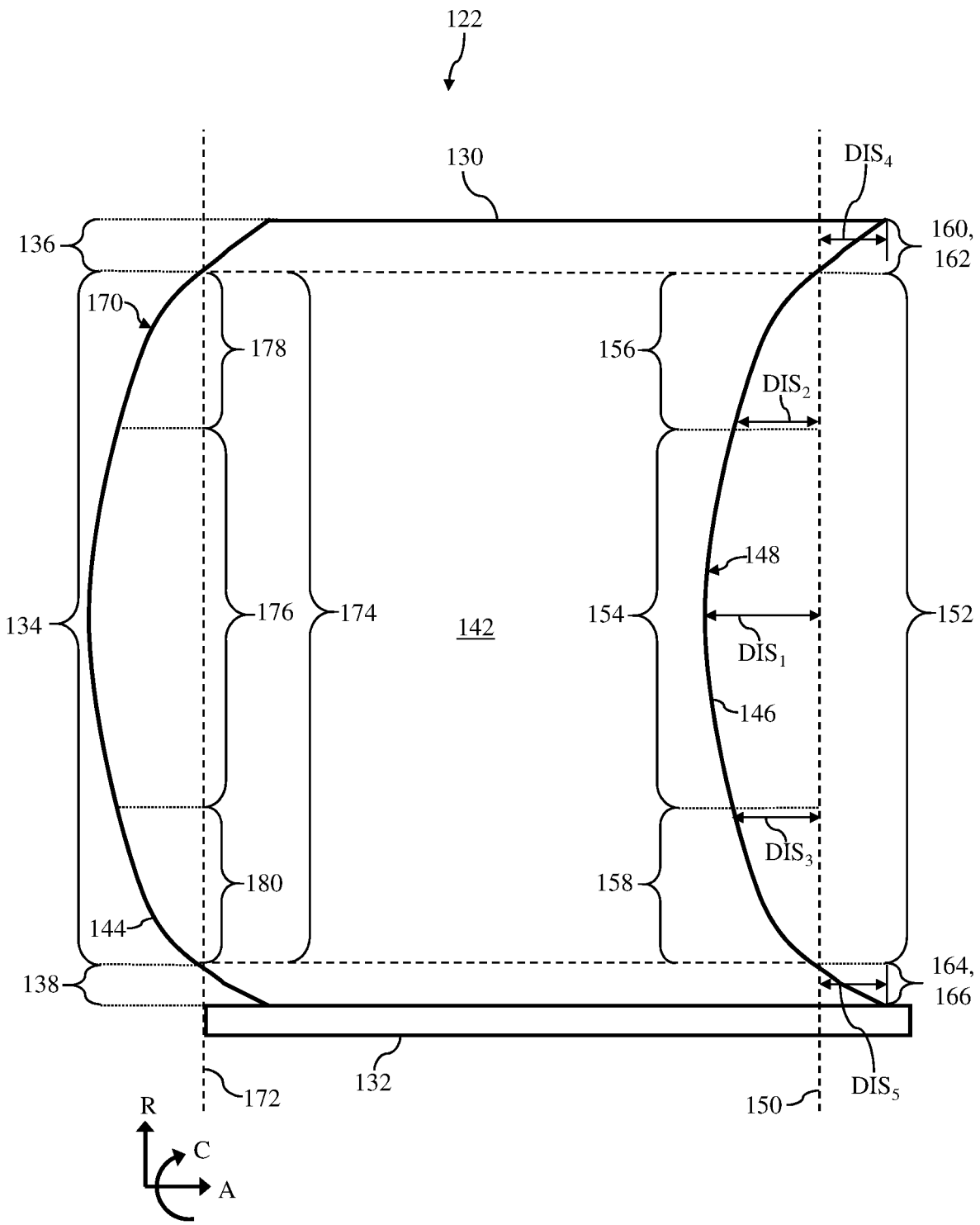
FIG. 11 shows a side view of a stator vane including a curved trailing edge of the gas turbine system of FIG. 2, according to other embodiments.

In the non-limiting example shown in FIG. 11, concave contour 148 of trailing edge 146 for stator vane 122 may be substantially similar to concave contour 148 discussed herein with respect to FIGS. 3-5. However, and distinct from stator vane 122 discussed herein with respect to FIGS. 3-5, stator vane 122 shown in FIG. 11 may also include a distinct geometry, shape and/or curvature for leading edge 144 of body 130. Specifically in the non-limiting example, and as shown in FIG. 11, leading edge 144 of body 130 may include a substantially convex contour 170 having a concavity that is formed and/or extends radially forward of central section 134 of body 130. In the non-limiting example, convex contour 170 of leading edge 144 may be substantially similar and/or may correspond to concave contour 148 of trailing edge 146. That is, convex contour 170 of leading edge 144 may include similar portions as concave contour 148 (e.g., first portion 152, second portion 160 and so on) that may include substantially similar geometries, shapes and/or curvatures, as well as, similar positions and/or axially offsets with respect to a distinct reference line 172 extending perpendicular to the axial direction of stator vane 122 and intersecting convex contour 170 at tip section 136 and root section 138, respectively. For example, and as shown in FIG. 11, convex contour 170 of leading edge 144 may include a distinct portion 174 radially aligned with central section 134 of body 130 and/or first portion 152 of concave contour 148 of trailing edge 146. Distinct portion 174 of convex contour 170 for leading edge 144 may substantially correspond and/or be substantially similar to first portion 152 of concave contour 148 of trailing edge 146. Specifically, and as similarly discussed herein with respect to first portion 152 shown in FIGS. 3-5, distinct portion 174 may be formed from various curvatures (e.g., curvatures 176, 178, 180) that may be axially offset, and positioned forward or axially upstream of distinct reference line 172. The shapes, geometries and/or curvatures of the various curvatures 176, 178, 180 of convex contour 170 may be substantially similar to the corresponding curvatures (e.g., first curvature 154, second curvature 156, third curvature 158) of first portion 152 of concave contour 148.

In other non-limiting examples, convex contour 170 for leading edge 144 may be substantially distinct and/or unique in shape and/or axial offset than concave contour 148 of trailing edge 146. That is, while trailing edge 146 in the example shown in FIG. 11 may be substantially similar to trailing edge 146 discussed herein with respect to FIG. 3-5, convex contour 170 of leading edge 144 may be substantially similar to concave contour 148 discussed herein with respect to FIGS. 6 and 7, and the entirety of convex contour 170 may be axially offset and positioned forward or axially upstream of distinct reference line 172.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A stator vane comprising:

a body including:

a root section including a root and defining a first radial span immediately adjacent to the root;

a tip section including a tip and defining a second radial span immediately adjacent to the tip, the tip section opposite the root section;

a central section positioned radially below the tip section and radially above the ti root section, the central section having a third radial span extending between the first radial span and the second radial span, the third radial span comprising a majority of a radial length of the body;

a leading edge extending radially from the root to the tip and radially along the root section, the central section, and the tip section; and a trailing edge positioned opposite the leading edge, the trailing edge including:

a concave contour including a first portion radially disposed within the central section of the body and extending radially between the tip section and the root section, the first portion axially offset and forward of a reference line that is perpendicular to an axial direction and that intersects the concave contour at the tip section and the root section;

wherein the first portion of the concave contour of the trailing edge includes:

a first curvature;

a second curvature positioned radially above the first curvature, the second curvature distinct from the first curvature; and a third curvature positioned radially below the first curvature, the third curvature substantially similar to or distinct from the second curvature.

2. The stator vane of claim 1, wherein the concave contour of the trailing edge includes:

a second portion radially disposed within the tip section of the body, the second portion axially offset from the first portion and one of:

aft of the reference line that is perpendicular to the axial direction and that intersects the concave contour at the tip section, forward of the reference line that is perpendicular to the axial direction and that intersects the concave contour at the tip section, or partially aft and partially forward of the reference line that is perpendicular to the axial direction and that intersects the concave contour at the tip section.

3. The stator vane of claim 2, wherein the second portion includes a fourth curvature substantially similar to or distinct from the second curvature of the first portion of the concave contour of the trailing edge.

4. The stator vane of claim 2, wherein the concave contour of the trailing edge includes:

a third portion radially disposed within the root section of the body, the third portion axially offset from the first portion and one of:

aft of the reference line that is perpendicular to the axial direction and that intersects the concave contour at the root section, forward of the reference line that is perpendicular to the axial direction and that intersects the concave contour at the root section, or partially aft and partially forward of the reference line that is perpendicular to the axial direction and that intersects the concave contour at the root section.

5. The stator vane of claim 4, wherein the third portion includes a fifth curvature substantially similar to or distinct from the third curvature of the first portion of the concave contour of the trailing edge.

6. The stator vane of claim 1, wherein the first curvature of the first portion of the concave contour of the trailing edge is axially offset and forward of the reference line by a distance of approximately 5% to approximately 25% of an axial length of the body.

7. The stator vane of claim 1, wherein the first portion of the concave contour of the trailing edge includes a variable curvature.

8. The stator vane of claim 1, wherein the third radial span of the central section is disposed over approximately 50% to approximately 90% of the radial length of the body.

9. The stator vane of claim 1, wherein the leading edge includes a distinct portion having a convex contour, the distinct portion being radially disposed within the central section of the body.

10. The stator vane of claim 9, wherein the convex contour of the distinct portion of the leading edge substantially corresponds in shape to the first portion of the concave contour of the trailing edge.

11. A turbine system including:

a rotor;

a plurality of turbine blades positioned circumferentially around the rotor; and a plurality of stator vanes positioned adjacent and axially forward from the plurality of turbine blades, each of the plurality of stator vanes including:

a body including:

a root section including a root and defining a first radial span immediately adjacent to the root;

a tip section including a tip and defining a second radial span immediately adjacent to the tip, the tip section opposite the root section;

a central section positioned radially below the tip section and radially above the tip root section, the central section having a third radial span extending between the first radial span and the second radial span, the third radial span comprising a majority of a radial length of the body;

a leading edge extending radially from the root to the tip and radially along the root section, the central section, and the tip section; and a trailing edge positioned opposite and aft to the leading edge, the trailing edge including:

a concave contour including a first portion radially disposed within the central section of the body and extending radially between the tip section and the root section, the first portion axially offset and forward of a reference line that is perpendicular to an axial direction and that intersects the concave contour at the tip section and the root section;

wherein the first portion of the concave contour of the trailing edge for each stator vane includes:

a first curvature;

a second curvature positioned radially above the first curvature, the second curvature distinct from the first curvature; and a third curvature positioned radially below the first curvature, the third curvature substantially similar to or distinct from the second curvature.

12. The turbine system of claim 11, wherein the first curvature of the first portion of the concave contour of the trailing edge for each stator vane is axially offset and forward of the reference line by a distance of approximately 5% to approximately 25% of an axial length of the body.

13. The turbine system of claim 11, wherein the first curvature of the first portion of the concave contour of the trailing edge for each stator vane is axially offset and forward of an axially aligned turbine blade of the plurality of turbine blades by a distance of approximately 10% to approximately 50% of a pitch between two, adjacent stator vanes of the plurality of stator vanes.

14. The turbine system of claim 11, wherein the concave contour of the trailing edge includes:

a second portion radially disposed within the tip section of the body, the second portion axially offset from the first portion and one of:

aft of the reference line that is perpendicular to the axial direction and that intersects the concave contour at the tip section, forward of the reference line that is perpendicular to the axial direction and that intersects the concave contour at the tip section, or partially aft and partially forward of the reference line that is perpendicular to the axial direction and that intersects the concave contour at the tip section.

15. The turbine system of claim 11, wherein the concave contour of the trailing edge includes:

a third portion radially disposed within the root section of the body, the third portion axially offset from the first portion and one of:

aft of the reference line that is perpendicular to the axial direction and that intersects the concave contour at the root section, forward of the reference line that is perpendicular to the axial direction and that intersects the concave contour at the root section, or partially aft and partially forward of the reference line that is perpendicular to the axial direction and that intersects the concave contour at the root section.

16. The turbine system of claim 11, wherein the first portion of the concave contour of the trailing edge for each stator vane includes a variable curvature.

17. The turbine system of claim 11, wherein the third radial span of the central section of the body for each stator vane is disposed over approximately 50% to approximately 90% of the radial length of the body.

* * * * *